US011713178B2

(12) United States Patent
Beckerman et al.

(10) Patent No.: US 11,713,178 B2
(45) Date of Patent: Aug. 1, 2023

(54) CONTAINER INCLUDING DRAINAGE FEATURES AND HANDLE

(71) Applicant: SHELL PACKAGING CORPORATION, Berkeley Heights, NJ (US)

(72) Inventors: Justin L. Beckerman, Mendham, NJ (US); Stephen M. Beckerman, Mendham, NJ (US)

(73) Assignee: Shell Packaging Corporation, Berkeley Heights, NJ (US)

( * ) Notice: Subject to any disclaimer, the term of this patent is extended or adjusted under 35 U.S.C. 154(b) by 49 days.

(21) Appl. No.: 17/544,464

(22) Filed: Dec. 7, 2021

(65) Prior Publication Data

US 2023/0174288 A1 Jun. 8, 2023

(51) Int. Cl.

| | |
|---|---|
| ***B65D 81/26*** | (2006.01) |
| ***B65D 25/28*** | (2006.01) |
| ***B65D 1/42*** | (2006.01) |

(52) U.S. Cl.

CPC ..... *B65D 81/261* (2013.01); *B65D 1/42* (2013.01); *B65D 25/2885* (2013.01)

(58) Field of Classification Search

CPC ..... B65D 11/08; B65D 11/26; B65D 11/22; B65D 25/005; B65D 25/2885; B65D 25/2882; B65D 81/261; B65D 81/262; B65D 81/26; B65D 1/46; B65D 1/42; B65D 21/0209; B65D 21/0224

USPC ..... 220/601, 661, 571, 648, 647, 646, 659, 220/509, 507, 4.27, 4.26; 206/509, 510

See application file for complete search history.

(56) References Cited

U.S. PATENT DOCUMENTS

| | | | | |
|---|---|---|---|---|
| 2,758,742 | A * | 8/1956 | Farrell | B65D 1/243 220/511 |
| 2,850,204 | A * | 9/1958 | Rehrig | B65D 85/80 220/628 |
| 2022/0081167 | A1* | 3/2022 | Huizingh | B65D 25/54 |
| 2022/0297883 | A1* | 9/2022 | Roelofs | B65D 21/0213 |

OTHER PUBLICATIONS

Photographs of Various Commercially Available Container Products, Admitted Prior Art, (Dec. 1, 2020).

* cited by examiner

*Primary Examiner* — Robert J Hicks
(74) *Attorney, Agent, or Firm* — Volpe Koenig

(57) ABSTRACT

A container is presented herein that includes a plurality of sidewalls defining an upper rim, and a base. At least one handle is defined integrally with at least one horizontal reinforcement rib. A skirt extends along the sidewalls above the base. Drainage openings are defined below the skirt and at an intersectional area defined between the base and at least one of the sidewalls.

20 Claims, 9 Drawing Sheets

CONTAINER INCLUDING DRAINAGE FEATURES AND HANDLE

FIELD OF INVENTION

The present disclosure is directed to a container, and is specifically directed to a container with a drainage feature and handles.

BACKGROUND

Containers, totes, bins, and storage units are well known. These known receptacles are typically formed via injection molding and can include a variety of features to assist with carrying, moving, and transporting. For example, many containers can be formed with handles. However, known handles can be uncomfortable for a user due to sharp or otherwise non-smooth edges. Accordingly, it would be desirable to provide a more ergonomical handle that is comfortable for a user.

It is also well known to include drainage elements on containers in order to mitigate any issues that can occur due to sprinklers being triggered and filling the containers with water, thereby making the containers excessively heavy and causing support structures to fail or collapse. While it is desirable to provide a sufficient amount of drainage elements on containers, removing too much material from the container walls or other surfaces to provide drainage holes can weaken the structural integrity of the containers.

Accordingly, there is a need to provide an improved container that is both comfortable to transport or carry by a user, and also provides a sufficient drainage system that does not weaken the container structure.

SUMMARY

A container is disclosed herein that includes an improved handle configuration and drainage system. The container includes sidewalls defining an upper rim, and a base. At least one horizontal reinforcement rib is provided that is spaced away from the upper rim, and at least one vertical reinforcement rib is also provided. At least one handle is provided on at least one of the sidewalls. The handle is formed integrally with the horizontal reinforcement rib and intersected by the vertical reinforcement rib. Drainage openings are arranged at an intersectional area defined between the base and at least one of the sidewalls. A perimeter of each of the drainage openings is partially defined by a portion of the at least one sidewall and by a portion of the base.

The container also includes a skirt located around a periphery of the container, and the drainage openings can be arranged below the skirt. A portion of the skirt can overlap with the drainage openings.

Drainage supports can be arranged between adjacent drainage openings. Drainage reinforcement elements can be defined on an internal surface of the base, and the drainage reinforcement elements can be connected to each of the drainage supports.

An upper edge of the drainage reinforcement elements and an upper edge of the drainage openings can be coplanar.

The drainage reinforcement elements can extend at an oblique angle relative to the drainage supports. The sidewalls can include two longitudinal sidewalls, and two lateral sidewalls, and the drainage openings can be only defined on the two longitudinal sidewalls. The handle can include a first handle defined on a first lateral sidewall and a second handle defined on a second lateral sidewall.

A vertical reinforcement rib can be provided that bisects the handle. The vertical reinforcement rib can extend from the upper rim to the handle, and possibly below the handle.

The horizontal reinforcement rib can be spaced apart from the upper rim by 2.0 inches to 3.0 inches.

The horizontal reinforcement rib can define a horizontal plane (P) and the handle can extend upwards relative to the horizontal plane (P).

Vertical handle reinforcement ribs can extend between the handle and an upper horizontal reinforcement rib.

In another aspect, a container is disclosed that includes sidewalls defining an upper rim, and a base. A handle is defined integrally with a horizontal reinforcement rib. A skirt can extend along the sidewalls above the base. Drainage openings can be defined below the skirt and at an intersectional area defined between the base and at least one of the sidewalls.

Additional embodiments are disclosed herein.

BRIEF DESCRIPTION OF THE DRAWINGS

The foregoing Summary and the following Detailed Description will be better understood when read in conjunction with the appended drawings, which illustrate a preferred embodiment of the disclosure. In the drawings.

DETAILED DESCRIPTION OF THE PREFERRED EMBODIMENTS

Figure 1:
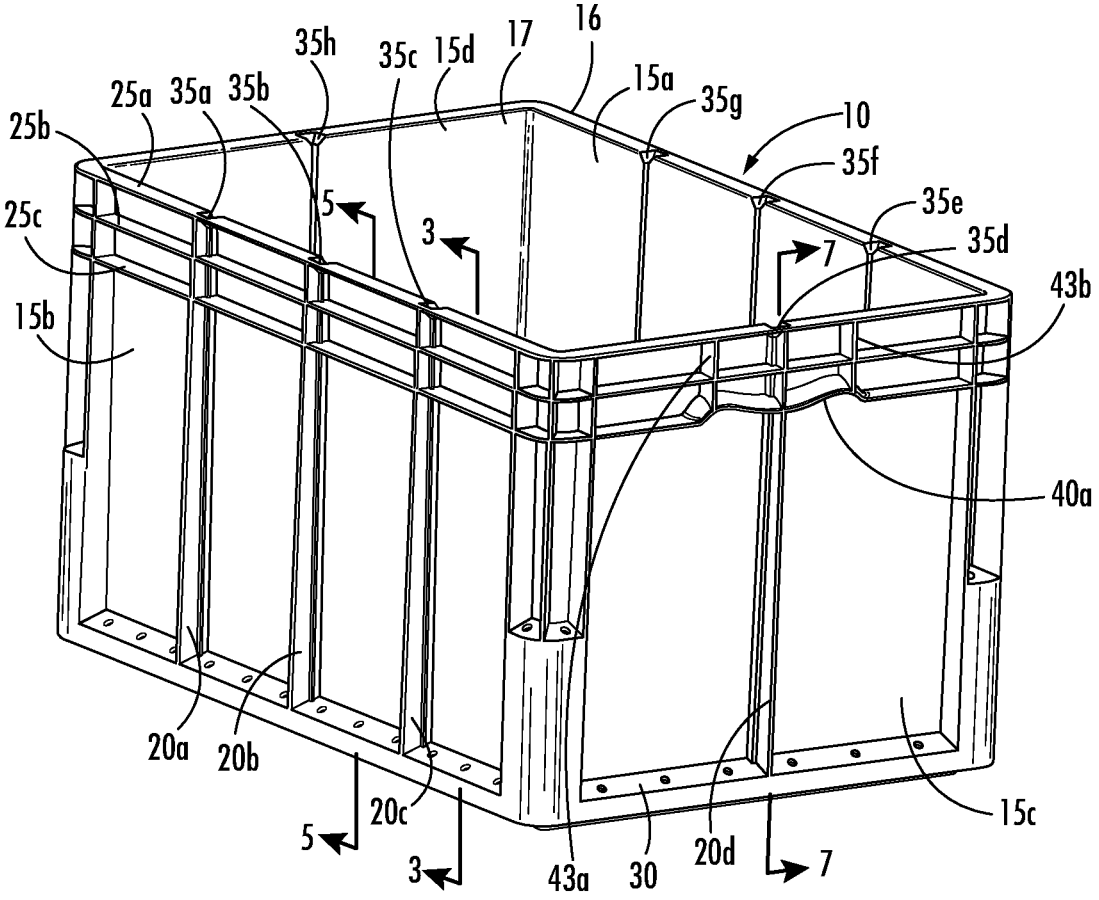
FIG. 1 is a top perspective view of a container according to the present disclosure.
Figure 2:
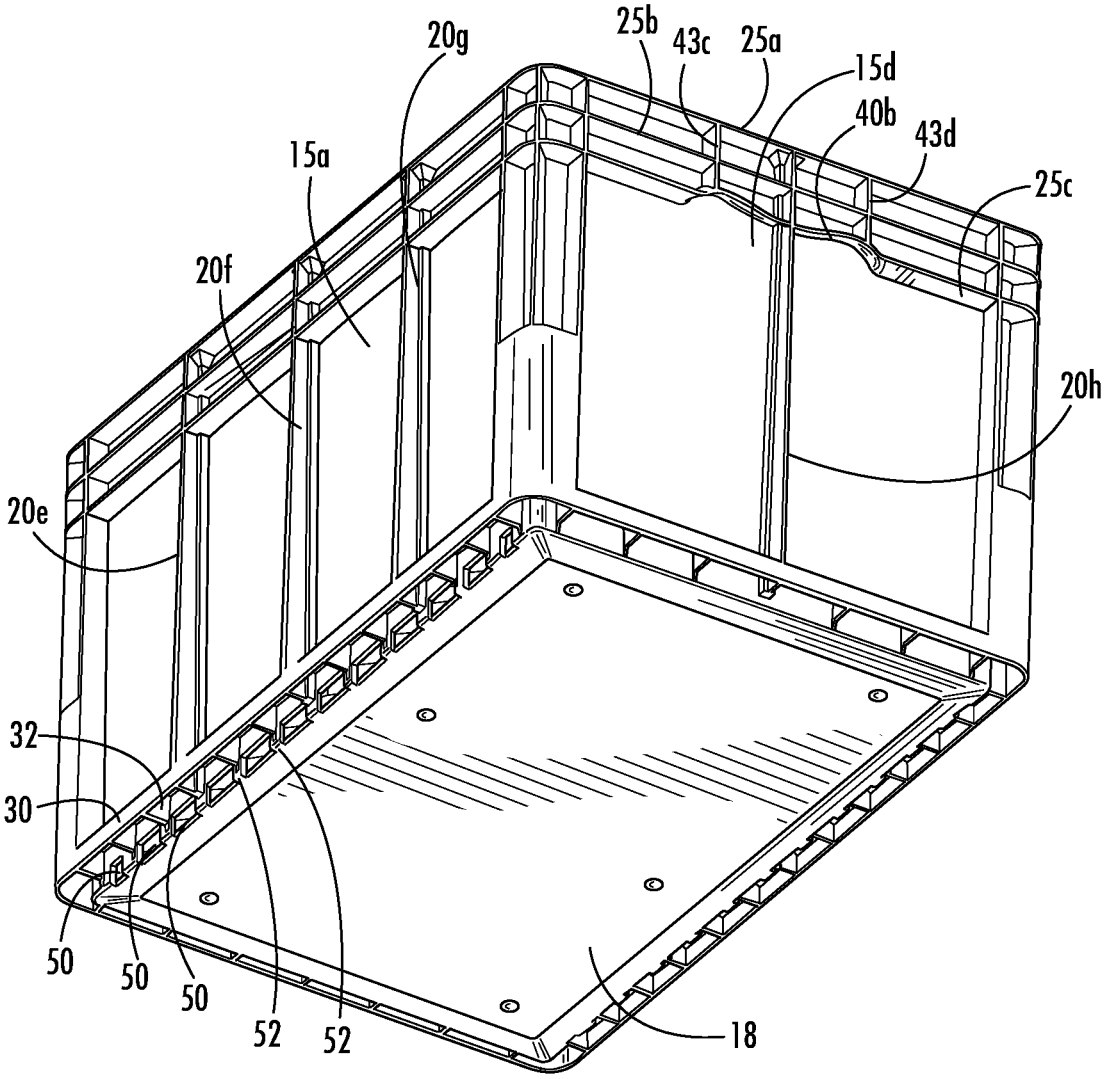
FIG. 2 is a bottom perspective view of the container of FIG. 1 from an opposite side as FIG. 1.
Figure 3:
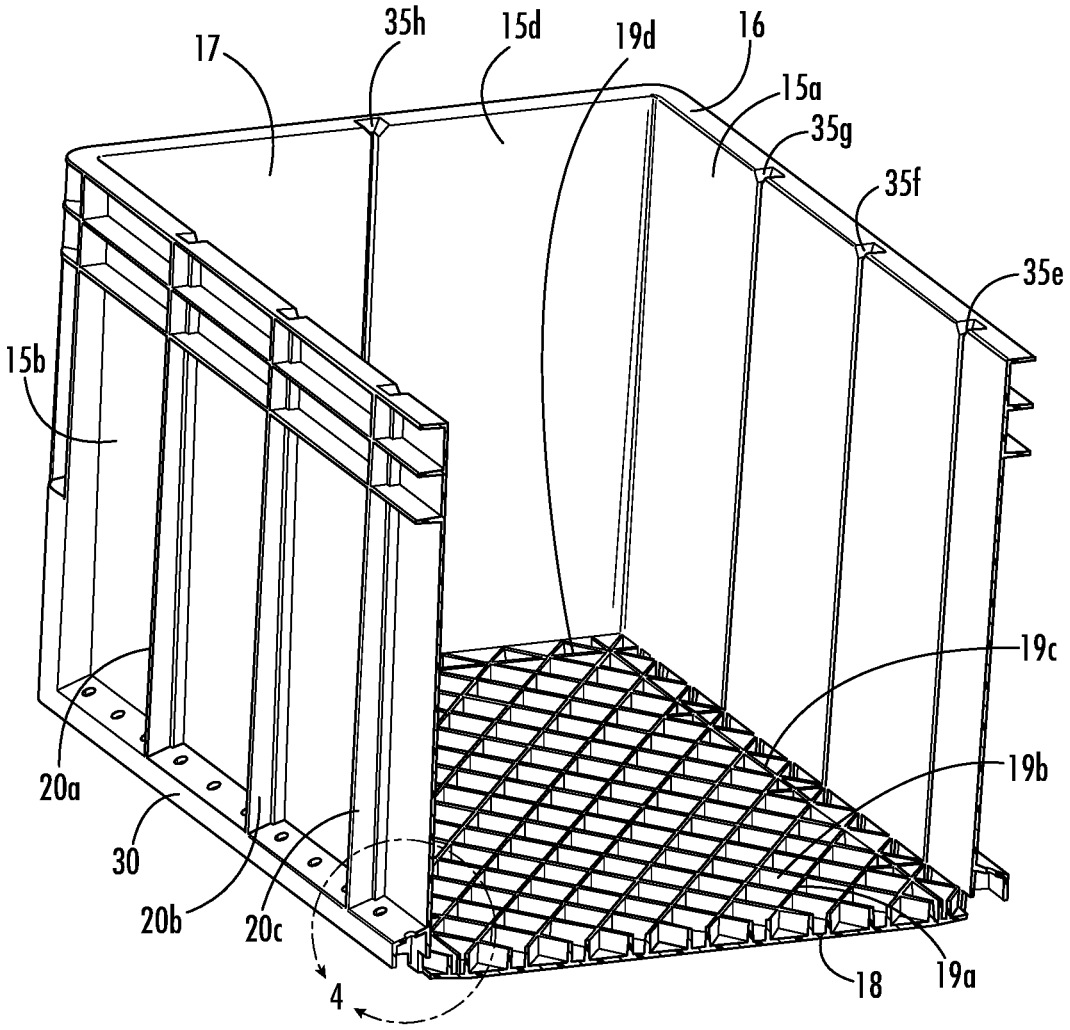
FIG. 3 is a cross-sectional perspective view along line "3-3" in FIG. 1.
Figure 4:
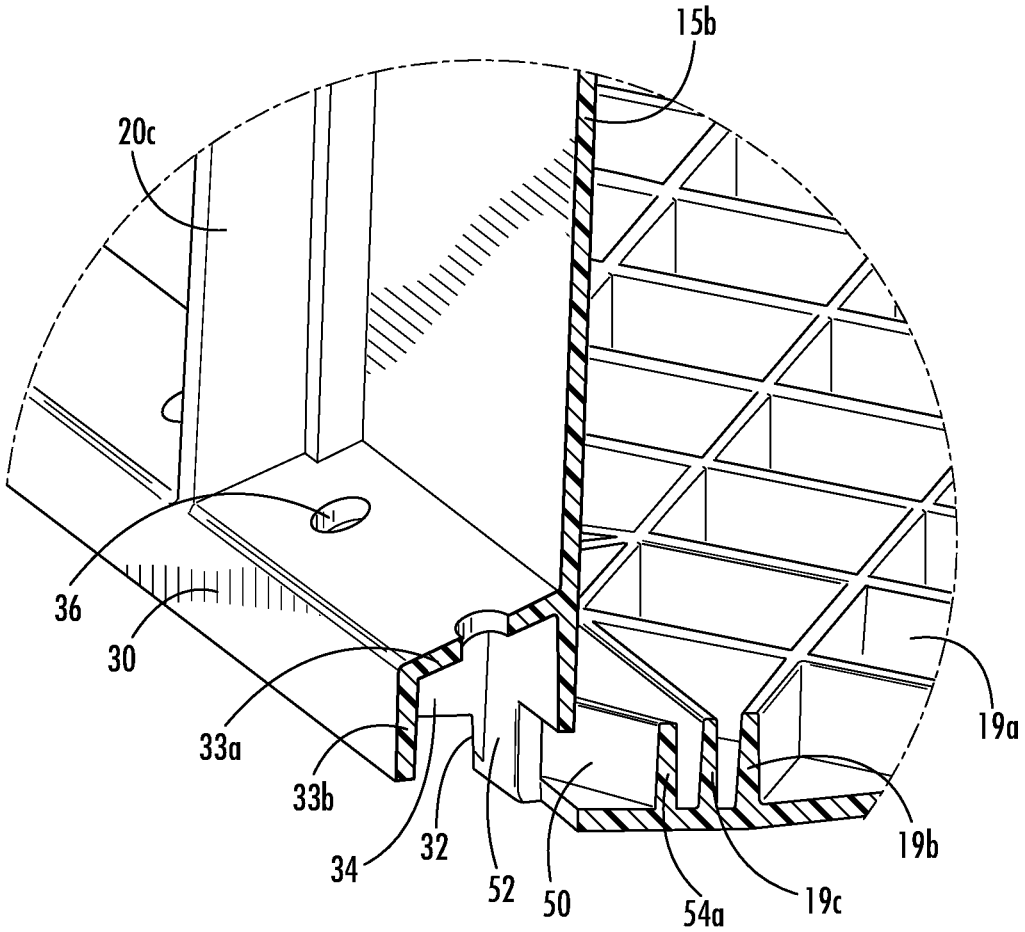
FIG. 4 is a magnified view from area "4" in FIG. 3.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. "Axially" refers to a direction along the axis of a shaft. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

A container 10 is generally shown in FIGS. 1-11. The container 10 can include a plurality of sidewalls, such as four sidewalls 15*a*, 15*b*, 15*c*, 15*d*. One of ordinary skill in the art would understand that additional sidewalls could be provided. The container 10 can have a rectangular profile, with two longer sidewalls 15*a*, 15*b* (i.e. longitudinal sidewalls) having a first length, and two shorter sidewalls 15*c*, 15*d* (i.e. lateral sidewalls) having a second length that is less than the first length. In another embodiment, the container 10 can have a square profile or any other shape profile. An upper rim 16 is defined by the top edges of the four sidewalls 15*a*-15*d*, such that a top of the container 10 defines an opening.

A base 18 is defined by the bottom ends of the four sidewalls 15*a*-15*d*. The sidewalls 15*a*-15*d* and the base 18 collectively define an interior 17. The base 18 is formed as a closed or solid bottom for the container 10. In one aspect, the base 18 defines a completely uninterrupted, solid bottom surface (i.e. a ground surface). As disclosed herein, the base 18 partially defines a perimeter of drainage openings 50, but the base 18 itself lacks any openings. Likewise, at least one of the sidewalls 15*a*, 15*b* partially defines a perimeter of drainage openings 50, but the sidewalls 15*a*-15*d* otherwise lack any other openings or holes.

One or more reinforcement structures can be provided for the container 10. Reinforcement structures may be defined on an exterior surface of the container 10 and/or an interior surface of the container 10. For example, one or more vertical reinforcement ribs 20*a*, 20*b*, 20*c*, 20*d*, 20*e*, 20*f*, 20*g*, 20*h* can be arranged along the sidewalls 15*a*-15*d*. The vertical reinforcement ribs 20*a*-20*h* can be arranged at a predetermined spacing from each other. In one aspect, the two longer sidewalls 15*a*, 15*b* can include at least three vertical reinforcement ribs 20*a*-20*c* and 20*e*-20*g* and the two shorter sidewalls 15*c*, 15*d* can include a single reinforcement rib 20*d*, 20*h*. One of ordinary skill in the art would understand that the quantity and positioning of the vertical reinforcement ribs can vary. The term vertical as used in this context means predominantly vertical or entirely vertical.

Slots 35*a*, 35*b*, 35*c*, 35*d*, 35*e*, 35*f*, 35*g*, 35*h* can be provided around a periphery of an internal surface of the container 10. The slots 35*a*-35*h* are dimensioned to receive ends of divider elements, which can be inserted and retained within the slots 35*a*-35*h* for providing different size compartments within the container 10. The slots 35*a*-35*h* can be formed partially in the structure defining the vertical reinforcement ribs 20*a*-20*h*.

In addition to vertical reinforcement ribs, the container 10 can also include one or more horizontal reinforcement ribs 25*a*, 25*b*, 25*c*. The horizontal reinforcement ribs 25*a*-25*c* can include three ribs, in one embodiment. Horizontal reinforcement rib 25*a* can be a first or an uppermost rib, horizontal reinforcement rib 25*b* can be a second or a medial rib, and horizontal reinforcement rib 25*c* can be a third or a lowermost rib. One of ordinary skill in the art would understand that the quantity and positioning of the horizontal reinforcement ribs can vary. The term horizontal as used in this context means predominantly horizontal or entirely horizontal.

One or more reinforcement structures can also be provided on the base 18. The reinforcement structures can be provided on an internal surface of the base 18 and/or an external surface of the base 18. In one embodiment, the base 18 includes a reinforcement web 19 that covers an entirety of the base 18. The reinforcement web 19 can include a plurality of crossing reinforcement members 19*a*, 19*b* that generally define a lattice profile. The crossing reinforcement members 19*a*, 19*b* could alternatively be arranged in a checkered pattern that is not angled relative to the sidewalls 15*a*-15*d*. Other profiles and patterns for the reinforcement web 19 can be used. Additional reinforcement members 19*c*, 19*d* can be provided in regions adjacent to the sidewalls 15*a*-15*d*. At least one longitudinal reinforcement member 19*c* can extend in a parallel direction relative to the sidewalls 15*a*, 15*b* and adjacent to the sidewalls 15*a*, 15*b*. At least one lateral reinforcement member 19*d* can extend in a parallel direction relative to the sidewalls 15*c*, 15*d* and adjacent to the sidewalls 15*c*, 15*d*. One of ordinary skill in the art would understand that more than one longitudinal reinforcement member 19*c* and more than one lateral reinforcement member 19*d* can be provided adjacent to each of the respective sidewalls 15*a*-15*d*.

A skirt 30 can be provided at a bottom region or area of the container 10. The skirt 30 generally includes a structure that extends outward from the sidewalls 15*a*-15*d*. The skirt 30 can extend around a periphery of the container 10. The skirt 30 can be continuous or may include distinct portions on one or more of the sidewalls 15*a*-15*d* and may not extend around the corners of the container 10. The vertical reinforcement ribs 20*a*-20*h* can intersect the skirt 30. The skirt 30 can extend outwardly in a lateral direction from the sidewalls 15*a*-15*d*. The skirt 30 can define a receptacle 32 configured to receive a rim or other portion of another container in order to assist with stacking multiple containers. Additionally, the skirt 30 can assist with guiding the container 10 along the sidewalls or rails of a conveyor. A plurality of skirt reinforcement elements 34 can be defined between the skirt 30 and a lower region of the sidewalls 15*a*-15*d*. The skirt 30 can include a lateral flange portion 33*a* and a vertical portion 33*b* extending cantilevered from the lateral flange portion 33*a*. The lateral flange portion 33*a* can have a slanted or sloped profile in a downward direction, in one aspect.

In one embodiment, a plurality of holes 36 can be provided in the skirt 30. These holes 36 can provide a manufacturing efficiency feature in that the holes 36 provide ventilation and prevent a vacuum from developing during molding steps. This helps reduce cycle time and assist with the ejection process. The holes 36 can be provided only along the portions of the skirt 30 on the longitudinal sidewalls 15*a*, 15*b*, in one embodiment. One of ordinary skill in the art would understand that the holes 36 can be provided on other portions of the skirt 30.

At least one handle 40*a*, 40*b* can be provided on the container 10. Preferably, the at least one handle 40*a*, 40*b* includes a pair of handles 40*a*, 40*b* on the lateral sidewalls 15*c*, 15*d*, respectively. In one embodiment, the handles 40*a*, 40*b* can be defined on the lowermost horizontal reinforcement rib 25*c*. The handles 40*a*, 40*b* can be defined integrally with the lowermost horizontal reinforcement rib 25*c*. One of ordinary skill in the art would understand that the handles 40*a*, 40*b* could be formed on other portions of the container 10, such as on other horizontal reinforcement ribs.

The handles 40*a*, 40*b* can have a curved profile defined between flat terminal ends 26*a*, 26*b* of the lower horizontal reinforcement rib 25*c*. The handles 40*a*, 40*b* generally can have a symmetrical profile on either side of a vertical reinforcement rib 20*d*, 20*h*. The handles 40*a*, 40*b* can be bisected by the vertical reinforcement ribs 20*d*, 20*h*. The profile of the handles 40*a*, 40*b* can have a wave-like shape or S-curve with identical regions R1, R2 on either side of the vertical reinforcement ribs 20*d*, 20*h*, in one embodiment. Alternatively, the handles 40*a*, 40*b* can be defined in a position such that the handles 40*a*, 40*b* are not intersected by the vertical reinforcement ribs 20*d*, 20*h*.

For additional support, handle reinforcement ribs 43*a*, 43*b*, 43*c*, 43*d* can be provided on either side of the respective vertical reinforcement ribs 20*d*, 20*h*. These handle reinforcement ribs 43*a*, 43*b*, 43*c*, 43*d* can extend in a vertical direction through the horizontal reinforcement rib 25*b*, and have terminal ends connected to the handles 40*a*, 40*b* and the horizontal reinforcement rib 25*a* or upper rim 16. The handles 40*a*, 40*b* can extend laterally beyond these reinforcement ribs 43*a*, 43*b*, 43*c*, 43*d*.

Based on the handles 40*a*, 40*b* being intersected by the vertical reinforcement ribs 20*d*, 20*h*, the slots 35*d*, 35*h*, which are defined on the internal surface of the container 10, can remain in a medial region of the sidewalls 15*c*, 15*d* and are uninterrupted by the structure of the handles 40*a*, 40*b*.

Figure 9:
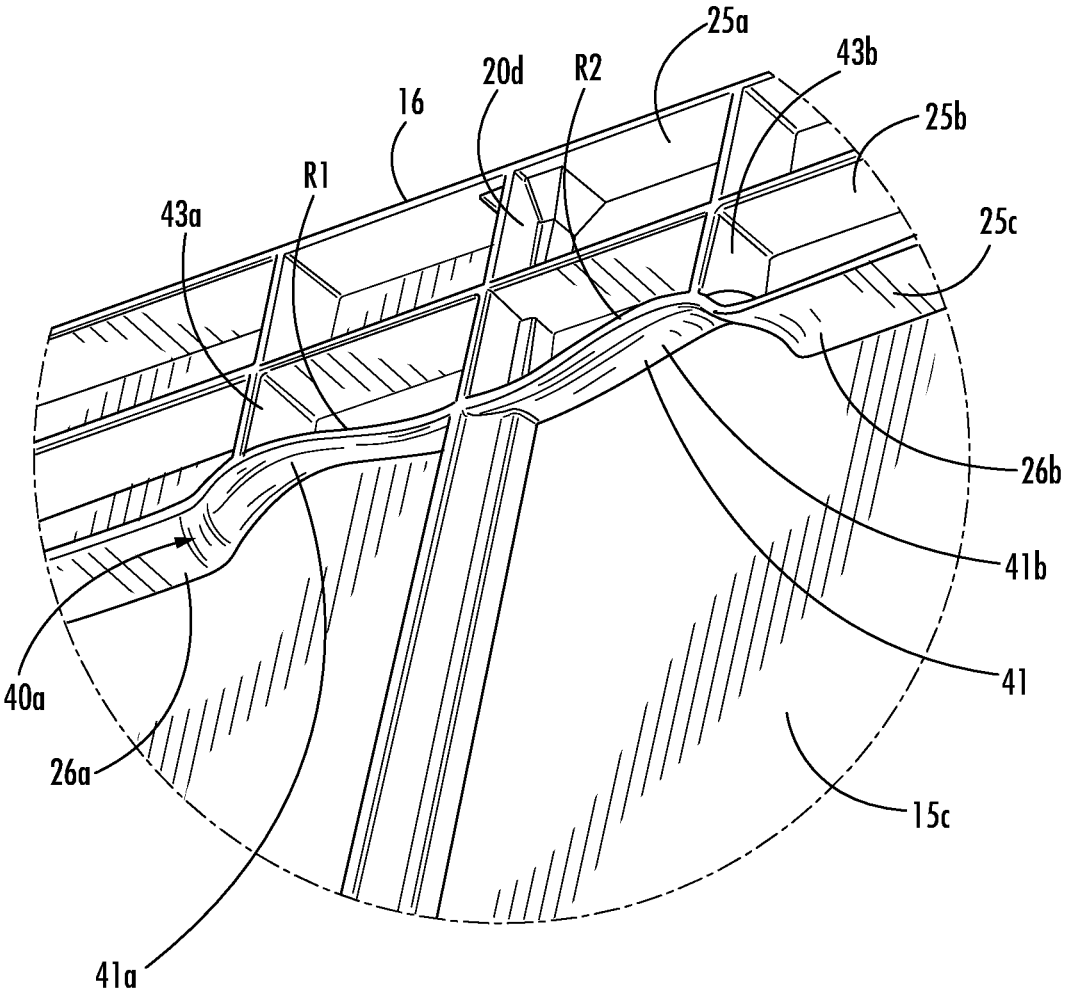
FIG. 9 is an upward of a handle of the container.
Figure 11:
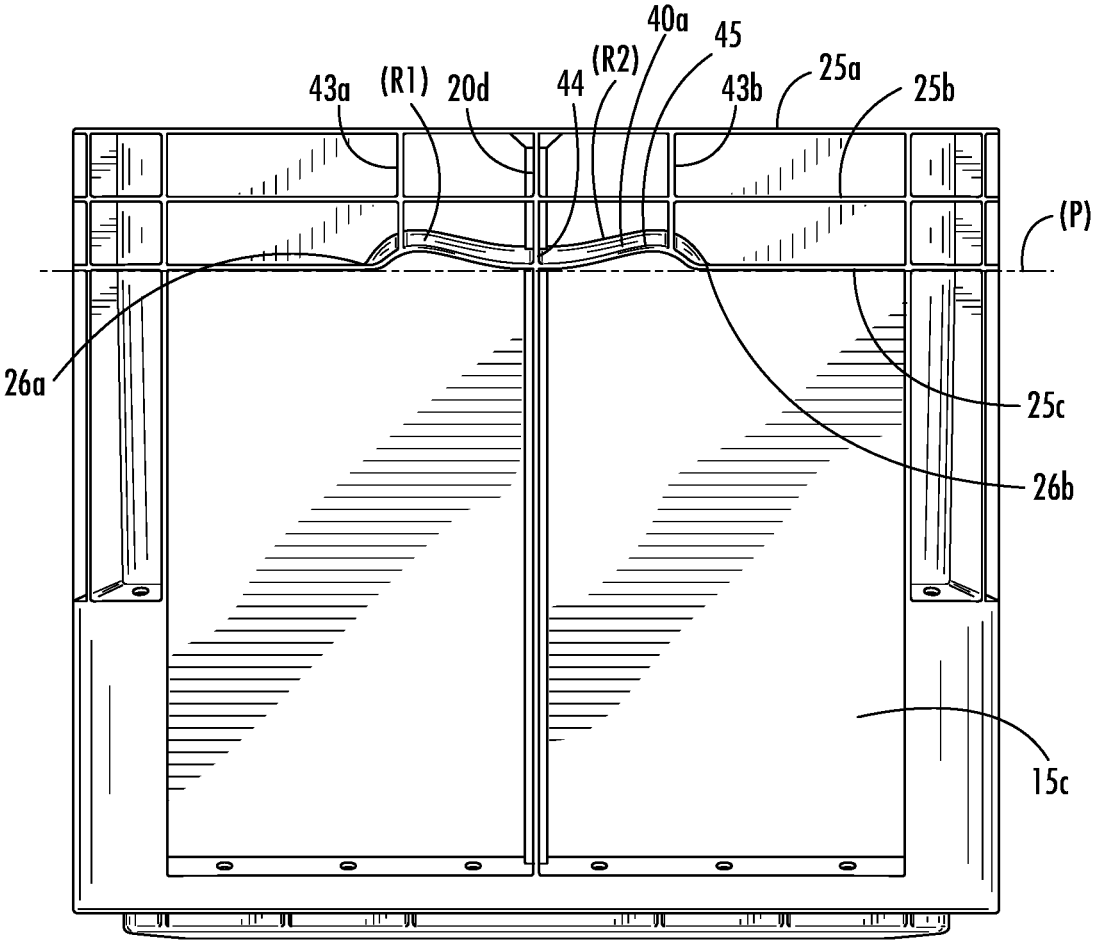
FIG. 11 is an end view of the container.

Preferably, the handles 40*a*, 40*b* do not have any sharp edges or ribs, and provide improved comfort for a user. The handles 40*a*, 40*b* each define a cavity 41 dimensioned to receive a portion of a user's hand when picking up and transporting the container 10. The cavity 41 can be split into two sub-cavities 41*a*, 41*b* on either side of the vertical reinforcement ribs 20*d*, 20*h*. As shown in FIG. 9, the cavity 41 is defined upward relative to the lower horizontal reinforcement rib 25*c*. As shown in FIG. 11, a horizontal plane (P) is defined by the horizontal reinforcement rib 25*c*. A majority of each of the handles 40*a*, 40*b* extends above the horizontal plane (P) and towards the upper rim 16 of the container 10. In one embodiment, a medial portion 44 of the handles 40*a*, 40*b* (which can be defined in an area of the vertical reinforcement ribs 20*d*, 20*h*) extends or dips downward relative to a remainder of the handles 40*a*, 40*b*. In this embodiment, the medial portion 44 of the handles 40*a*, 40*b* can touch the horizontal plane (P) or can be intersected by the horizontal plane (P). In another embodiment, the medial portion 44 of the handles 40*a*, 40*b* can be tangential to the horizontal plane (P). Based on this configuration, no portion of the handles 40*a*, 40*b* is defined below the horizontal plane (P). The handles 40*a*, 40*b* can be entirely defined above the horizontal plane (P) and the cavity 41 defined by the handles 40*a*, 40*b* can be defined above the horizontal plane (P). The handles 40*a*, 40*b* define an edge 45, which can have an undulating profile that has a constant curvature.

Figure 8:
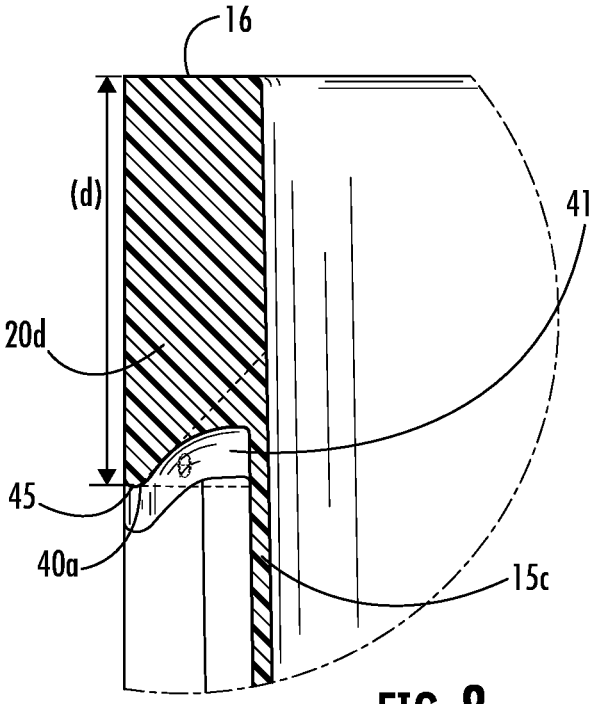
FIG. 8 is a magnified view from area "8" in FIG. 7.

As shown in FIG. 8, a distance (d) is defined between the upper rim 16 and the handles 40*a*, 40*b*. More specifically, this distance (d) is defined between the upper rim 16 and an edge 45 defined by the handles 40*a*, 40*b* in an area of the medial portion 44 (as shown by line 7-7 in FIG. 1). This distance (d) is between 1.75 inches to 3.0 inches, in one embodiment. In one embodiment, this distance (d) is more preferably between 2.0-2.8 inches, and most preferably approximately 2.4 inches. Based on the shape of the handles 40*a*, 40*b* and the curve of the edge 45, this distance will vary depending on the specific region of the handles 40*a*, 40*b* and their curvature. In one embodiment, an average distance between the edge 45 and the upper rim 16 is 2.0 inches-2.4 inches, and preferably is 2.2 inches. This distance ensures that a majority of users can easily and comfortably grip the containers 10 and engage both the upper rim 16 and the handles 40*a*, 40*b* for their grip.

As shown in FIG. 8, a negative angle (θ) is defined by the handles 40*a*, 40*b*. In one embodiment, this angle (θ) is between 30 degrees to 60 degrees. This value is selected to provide a positive gripped surface that is arranged opposite from the top rim. The handle has an undulating profile with a positive curvature that provides comfort and replaces an otherwise sharp and unconformable edge as used in known containers.

A drainage system is also integrated with the container 10. The drainage system can include a plurality of drainage openings 50 that are generally dimensioned to allow for the drainage of liquid, such as water, but are not so large as to jeopardize the structural integrity of the container 10. Conventional drainage holes cannot provide an adequate or maximum drainage rate due to their small diameter, while forming a large number of holes to provide sufficient drainage would compromise the integrity of the container. The drainage openings disclosed herein provide a maximum rate of drainage possible without compromising the integrity of the container structure.

In one aspect, the drainage openings 50 are only defined on at least one of the sidewalls 15*a*, 15*b* (i.e. the longitudinal sidewalls). The drainage openings 50 can be defined on both of the sidewalls 15*a*, 15*b*. One of ordinary skill in the art would understand that the drainage openings 50 could be defined on other regions of the container 10, including sidewalls 15*c*, 15*d* (i.e. the lateral sidewalls), or the base 18. In one embodiment, the base 18 and the sidewalls 15*c*, 15*d* lack any drainage openings. The drainage openings 50 can be defined as rectangular openings arranged in a single row.

Figure 6:
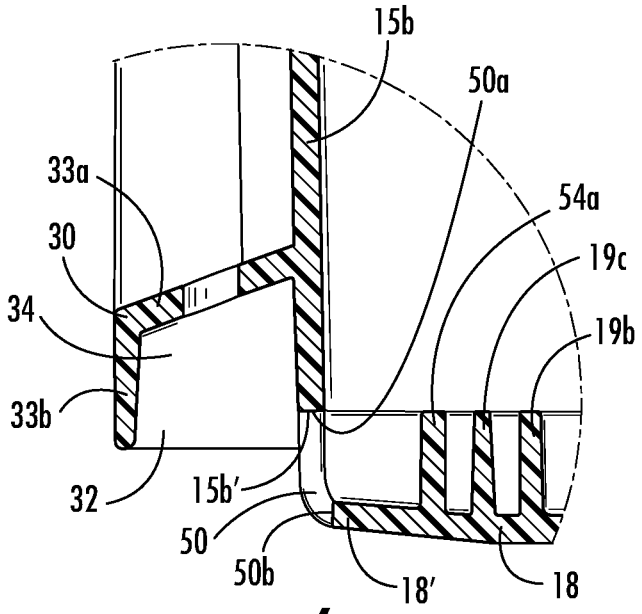
FIG. 6 is a magnified view of area "6" in FIG. 5.

The drainage openings 50 can be defined at an intersectional area between the sidewalls 15*a*, 15*b* and the base 18. As used in this context, the term intersectional area refers to a transition area between the sidewalls 15*a*, 15*b* and the base 18. As shown in FIG. 6, the sidewall 15*b* has a terminal end 15*b*' and the base 18 has a terminal end 18', and the drainage openings 50 can have a perimeter that is partially defined by both the terminal end 15*b*' of the sidewall 15*b* and the terminal end 18' of the base 18.

The skirt 30 and the drainage openings 50 can partially overlap in a horizontal direction, as shown in FIG. 6. More specifically, a portion of the vertical portion 33*b* of the skirt 30 can overlap with drainage openings 50. The skirt 30 partially covers the drainage openings 50 when viewed in a horizontal direction.

In order to account for the lack of material due to the drainage openings 50, drainage supports 52 and drainage reinforcement elements 54*a*, 54*b* can be provided. The drainage supports 52 can comprise vertical support members arranged between adjacent drainage openings 50. The drainage supports 52 can comprise portions of the sidewalls 15*a*, 15*b*, in one aspect. The skirt reinforcement elements 34 extend between the drainage supports 52 and the skirt 30.

Figure 10:
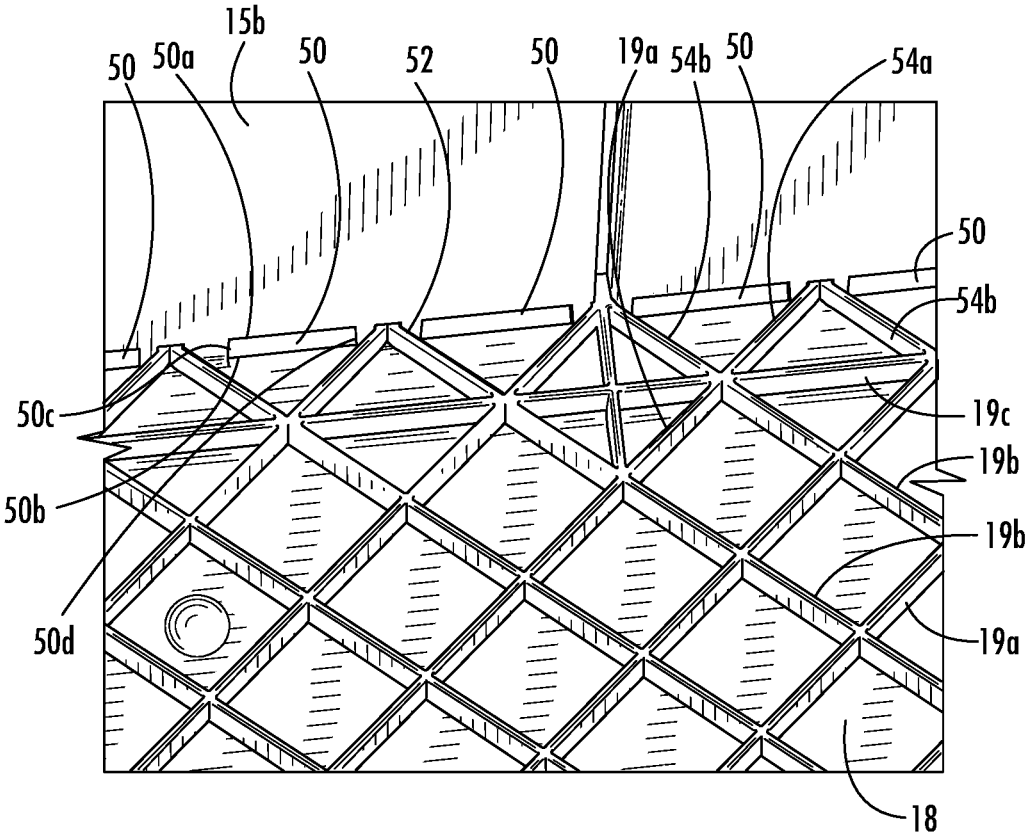
FIG. 10 is a magnified view of an interior area of the container.

The drainage reinforcement elements 54*a*, 54*b* can be defined on an internal surface of the base 18. The drainage reinforcement elements 54*a*, 54*b* can extend between the drainage supports 52 and the longitudinal reinforcement member 19*c*. The drainage reinforcement elements 54*a*, 54*b* can extend at an oblique angle relative to the longitudinal reinforcement member 19*c* and the drainage supports 52, as best shown in FIG. 10. The drainage reinforcement elements 54*a*, 54*b* can be considered extensions of respective ones of the plurality of crossing reinforcement members 19*a*, 19*b*, in one aspect. In other words, the lattice profile of the plurality of crossing reinforcement members 19*a*, 19*b* can also define the profile of the drainage reinforcement elements 54*a*, 54*b*.

The drainage openings 50 can have a perimeter including an upper edge 50*a* defined by the sidewalls 15*a*, 15*b*, a lower edge 50*b* defined by the base 18, and lateral edges 50*c*, 50*d* defined by the drainage supports 52 (i.e. portions of the sidewalls 15*a*, 15*b*).

Figure 5:
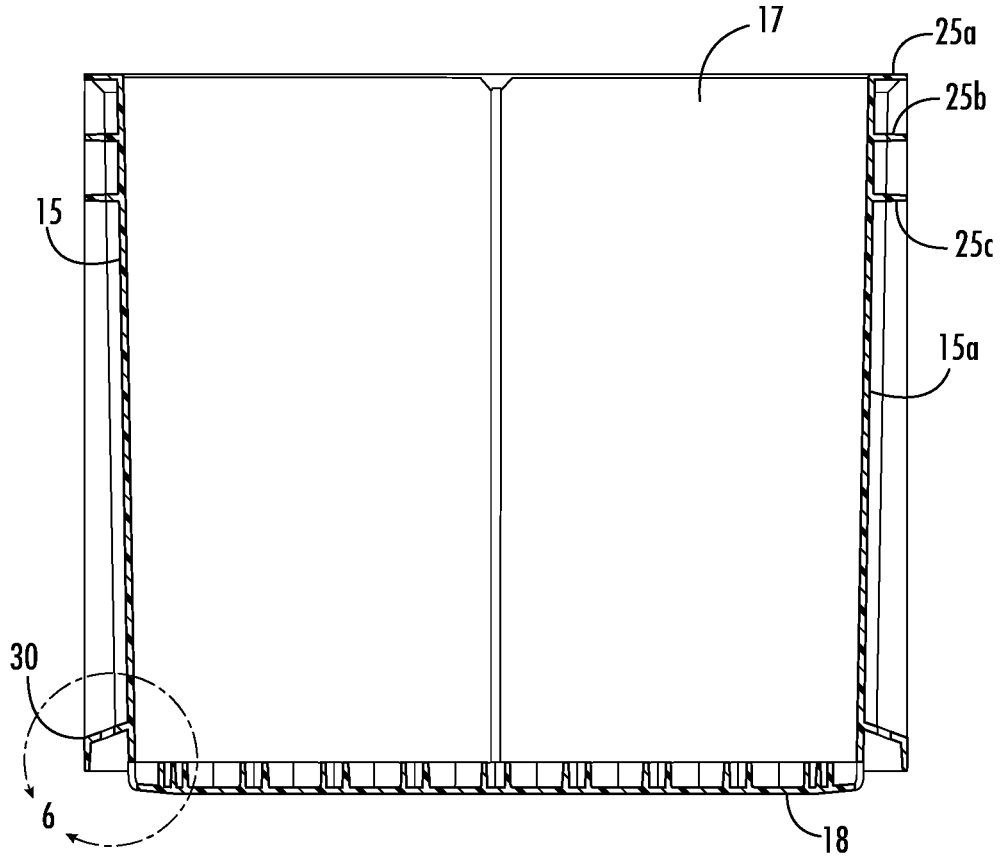
FIG. 5 is a cross-sectional planar view along line "5-5" in FIG. 1.
Figure 7:
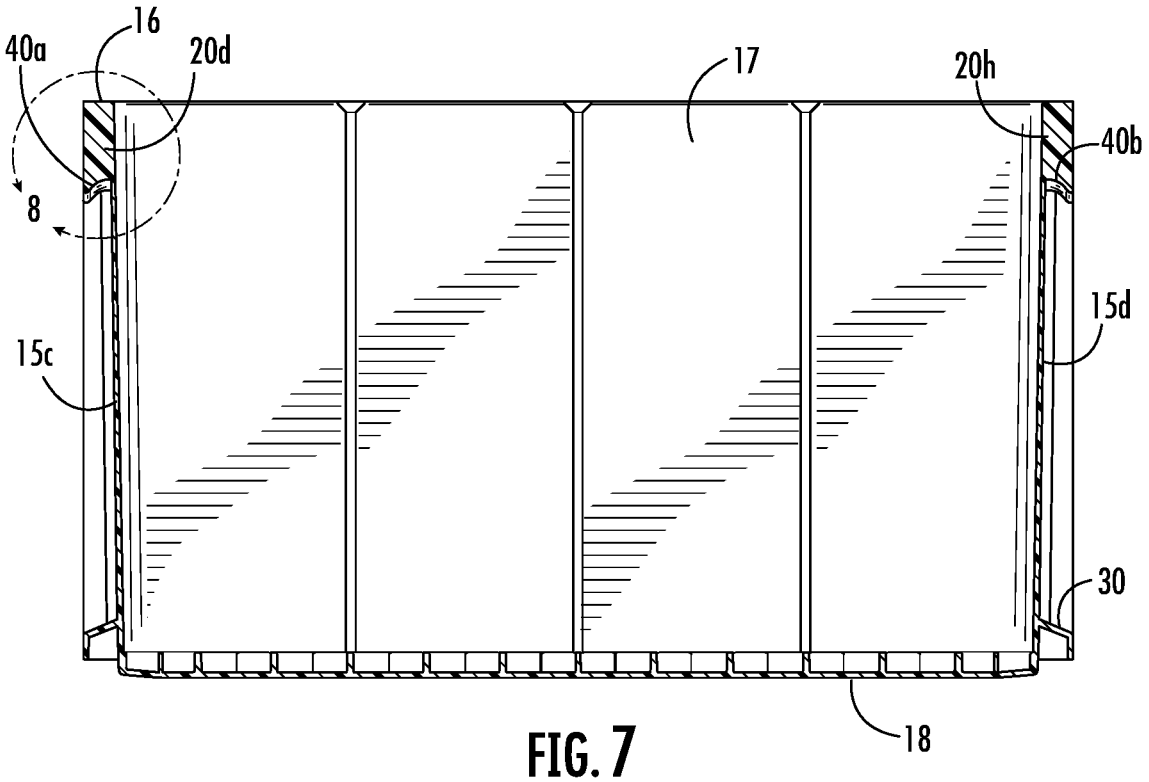
FIG. 7 is a cross-sectional view along line "7-7" in FIG. 1.

The plurality of drainage openings 50 can be positioned below the skirt 30. In one aspect, the container 10 disclosed herein lacks any drainage openings in the base 18, as best shown by FIGS. 5 and 7.

The drainage openings 50 can provide at least a 25%-35% open area, and preferably a 30% open area, within a predetermined lower region of the container 10. In one embodiment, the term predetermined lower region of the container 10 refers to an area of the container 10 having a height extending 0.5 inches upwards from a ground support.

The upper edge 50*a* of the drainage openings 50 (which can be defined by terminal end 15*b*' of the sidewall 15*b*) can be coplanar with (i) upper edges of the drainage reinforcement elements 54*a,* 54*b,* (ii) upper edges of the plurality of crossing reinforcement members 19*a,* 19*b,* and (iii) upper edges of the longitudinal reinforcement member 19*c,* as best shown in FIG. 6. In one aspect, this feature ensures that sensors, such as laser sensors or optical sensors, do not misread the presence or absence of the container 10 as it travels along a conveyor by shining or emitting a laser or other sensing element through an unobstructed opening in the container 10

The container 10 disclosed herein can have varying sizes and shapes. In one embodiment, the container 10 is approximately 24 inches×16 inches×15 inches. However, one of ordinary skill in the art would understand the dimensions and/or shape of the container 10 can vary.

In one aspect, the container 10 is formed via molding. For example, the container 10 can be formed via injection molding. The material used to form the container 10 can include crate grade high density polyethylene. In another embodiment, the container 10 can be formed via impact-resistant co-polymer polypropylene.

The handles 40*a,* 40*b* disclosed herein provide a comfortable interface for a user carrying the container 10. The handles 40*a,* 40*b* are easy to grasp with the first joint of a user's fingers and are dimensioned such that a user's palm can grasp the upper rim 16 of the container 10 with a fist-like grip. This configuration provides a positive grip on the container 10 and reduces pressure points that can be painful for a user.

Having thus described the present embodiments in detail, it is to be appreciated and will be apparent to those skilled in the art that many physical changes, only a few of which are exemplified in the detailed description of the disclosure, could be made without altering the inventive concepts and principles embodied therein.

It is also to be appreciated that numerous embodiments incorporating only part of the preferred embodiment are possible which do not alter, with respect to those parts, the inventive concepts and principles embodied therein.

The present embodiment and optional configurations are therefore to be considered in all respects as exemplary and/or illustrative and not restrictive, the scope of the disclosure being indicated by the appended claims rather than by the foregoing description, and all alternate embodiments and changes to this embodiment which come within the meaning and range of equivalency of said claims are therefore to be embraced therein.

**********

What is claimed is:

1. A container comprising:

a plurality of sidewalls defining an upper rim, and a base;

at least one horizontal reinforcement rib spaced away from the upper rim;

at least one vertical reinforcement rib;

at least one handle provided on at least one of the sidewalls, the at least one handle being formed integrally with the at least one horizontal reinforcement rib and intersected by the at least one vertical reinforcement rib; and a plurality of drainage openings arranged at an intersectional area defined between the base and at least one of the sidewalls, wherein a perimeter of each of the plurality of drainage openings is partially defined by a portion of the at least one sidewall and by a portion of the base.

2. The container according to claim 1, further comprising a skirt provided around a periphery of the container, wherein the plurality of drainage openings are arranged below the skirt.

3. The container according to claim 2, wherein a portion of the skirt overlaps with the plurality of drainage openings in a horizontal direction.

4. The container according to claim 1, further comprising a plurality of drainage supports arranged between adjacent drainage openings.

5. The container according to claim 4, further comprising a plurality of drainage reinforcement elements defined on an internal surface of the base, the plurality of drainage reinforcement elements being connected to each of the drainage supports.

6. The container according to claim 5, wherein an upper edge of the plurality of drainage reinforcement elements and an upper edge of the plurality of drainage openings are coplanar.

7. The container according to claim 5, wherein the plurality of drainage reinforcement elements extend at an oblique angle relative to the plurality of drainage supports.

8. The container according to claim 1, wherein the plurality of sidewalls includes two longitudinal sidewalls and two lateral sidewalls, and the plurality of drainage openings are only defined on the two longitudinal sidewalls.

9. The container according to claim 8, wherein the at least one handle includes a first handle defined on a first lateral sidewall of the two lateral sidewalls and a second handle defined on a second lateral sidewall of the two lateral sidewalls.

10. The container according to claim 1, wherein the at least one handle is bisected by the at least one vertical reinforcement rib.

11. The container according to claim 10, wherein the at least one vertical reinforcement rib extends from the upper rim to at least the at least one handle.

12. The container according to claim 1, wherein the at least one horizontal reinforcement rib is spaced from the upper rim by 2.0 inches to 3.0 inches.

13. The container according to claim 1, wherein the at least one horizontal reinforcement rib defines a horizontal plane (P) and the at least one handle extends upward relative to the horizontal plane (P).

14. The container according to claim 1, wherein the at least one vertical reinforcement rib includes at least three vertical reinforcement ribs extending between the at least one handle and the upper rim.

15. A container comprising:

a plurality of sidewalls defining an upper rim, and a base;

a skirt extending along the plurality of sidewalls above the base; and a plurality of drainage openings defined below the skirt at an intersectional area between the base and at least one of the sidewalls.

16. The container according to claim 15, further comprising drainage reinforcement elements defined on an internal surface of the base, the drainage reinforcement elements extending obliquely relative to drainage supports defined between adjacent drainage openings.

17. The container according to claim 15, wherein a perimeter of the plurality of drainage openings is defined partially by the base and partially by the plurality of sidewalls.

18. The container according to claim 15, further comprising at least one handle defined integrally with at least one horizontal reinforcement rib.

19. The container according to claim 18, further comprising at least three vertical reinforcement ribs that extend from the upper rim to the at least one handle.

20. The container according to claim 19, wherein at least one of three vertical reinforcement ribs intersects the at least one handle in a medial region of the at least one handle.

* * * * *